United States Patent [19]

Olson

[11] Patent Number: 4,551,649

[45] Date of Patent: Nov. 5, 1985

[54] ROUNDED-END PROTUBERANCES FOR FIELD-EMISSION CATHODES

[75] Inventor: Roy E. Olson, Granada Hills, Calif.

[73] Assignee: Rockwell International Corporation, El Segundo, Calif.

[21] Appl. No.: 559,543

[22] Filed: Dec. 8, 1983

[51] Int. Cl.[4] ..... A47B 88/00

[52] U.S. Cl. ..... 313/336; 313/304; 313/309

[58] Field of Search ..... 313/336, 302, 304, 309

[56] References Cited

U.S. PATENT DOCUMENTS

| | | | |
|---|---|---|---|
| 2,636,141 | 4/1953 | Parker | 313/304 X |
| 4,163,918 | 8/1979 | Shelton | 313/309 |
| 4,178,531 | 12/1979 | Alig | 313/409 |
| 4,325,000 | 4/1982 | Wolfe et al. | 313/336 |
| 4,345,181 | 8/1982 | Shelten | 313/309 |

FOREIGN PATENT DOCUMENTS

| | | | |
|---|---|---|---|
| 48-19498 | 6/1973 | Japan | 313/336 |

OTHER PUBLICATIONS

IBM Technical Disclosure Bulletin, Cohen et al., S 8746, vol. 20, #9, pp. 3721–3722, 2/1978.

*Primary Examiner*—Robert Lindsay

*Attorney, Agent, or Firm*—H. Fredrick Hamann; Harry B. Field

[57] ABSTRACT

Protuberances, or posts 14, for field-emission cathodes, the posts 14 having rounded emitting tips 12. Control of the radius R, of the emitting tips 12 controls the factor $10^8/\beta V$ upon which the current density of each post 14 depends. Proper radius selection for a given value of applied voltage, V, keeps the operating point of the cathode 10 on a region of the current density vs $10^8/\beta V$ curve well below the region of impedance collapse, CG.

7 Claims, 12 Drawing Figures

ROUNDED-END PROTUBERANCES FOR FIELD-EMISSION CATHODES

BACKGROUND OF THE INVENTION

1. Field of the Invention

This invention relates to field-emission (cold) cathodes and especially to rounded-end-protuberance emitters for cold cathodes.

2. Description of the Prior Art

Present field-emission cathodes, such as pointed protuberance (carbon felt) or cross-hatched types, are characterized by the fact that the emitting edges or points are sharp. Only low current densities can be handled by sharp-edged emitters since they melt and vaporize at large current densities such as are required for electron-beam-pumped lasers.

A second problem exists with pointed-end-protuberance cold cathodes. Residual gases in the device are ionized by the intense field existing at the point. Once started, ionization proceeds rapidly from cathode to anode resulting in a strong increase in current, and, if the ionization reaches the anode, can short out the cold-cathode device. Thus, this type of device can only be operated in extremely short pulse durations. The ionization results in a drop of anode-to-cathode impedance called "impedance collapse".

OBJECTS OF THE INVENTION

An object of the invention is to obtain increased current emission with cold-cathode devices without melting and vaporization of the emitters.

Another object is to increase field intensities in field-emission devices having emitters of the protuberance type without producing ionization of residual gases.

Further objects are to increase the reliability, decrease the wear and decrease the cost of field-emission-cathode devices.

Other objects, advantages and novel features of the present invention will become apparent from the following detailed description of the invention when considered in conjunction with the accompanying drawing.

SUMMARY OF THE INVENTION

The objects and advantages of the invention are achieved by cathodes for field-emission-cathode devices which have a cathode base member formed with a plurality of protuberances, or posts, having rounded ends. The value of the radius of the rounded end of the post is chosen in relation to the desired anode-to-cathode voltage so that the operating point of the field-emission device is on the straight portion of the cathode current density vs $10^8/\beta V$ curve well below the point at which the curve intersects the space-charge-limited emission curve, thus avoiding any tendency for "impedance collapse" to occur. When desired, a portion of the surface area of each rounded end may be coated with electron-emissive material having a low work function and serves as the emitting area.

BRIEF DESCRIPTION OF THE DRAWINGS

The same elements or parts throughout the figures of the drawing are designated by the same reference characters while equivalent elements bear a prime designation.

DETAILED DESCRIPTION OF THE PREFERRED EMBODIMENTS

Figure 1:
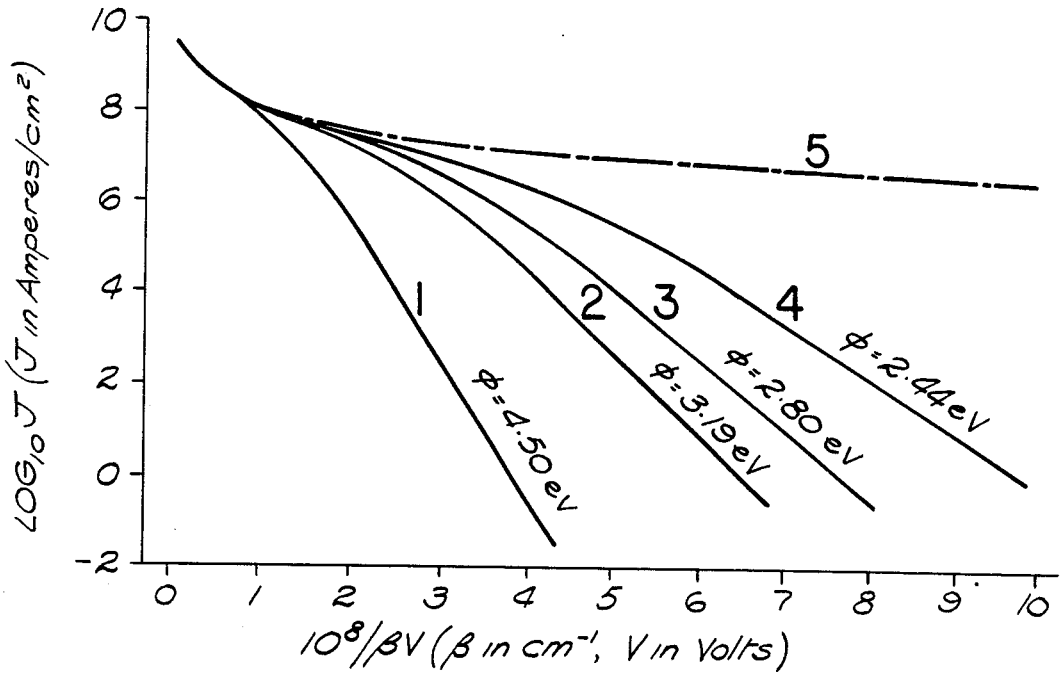
FIG. 1 is a graph showing emitter current density vs $10^8/\beta V$ values for field emission devices.
Figure 2:
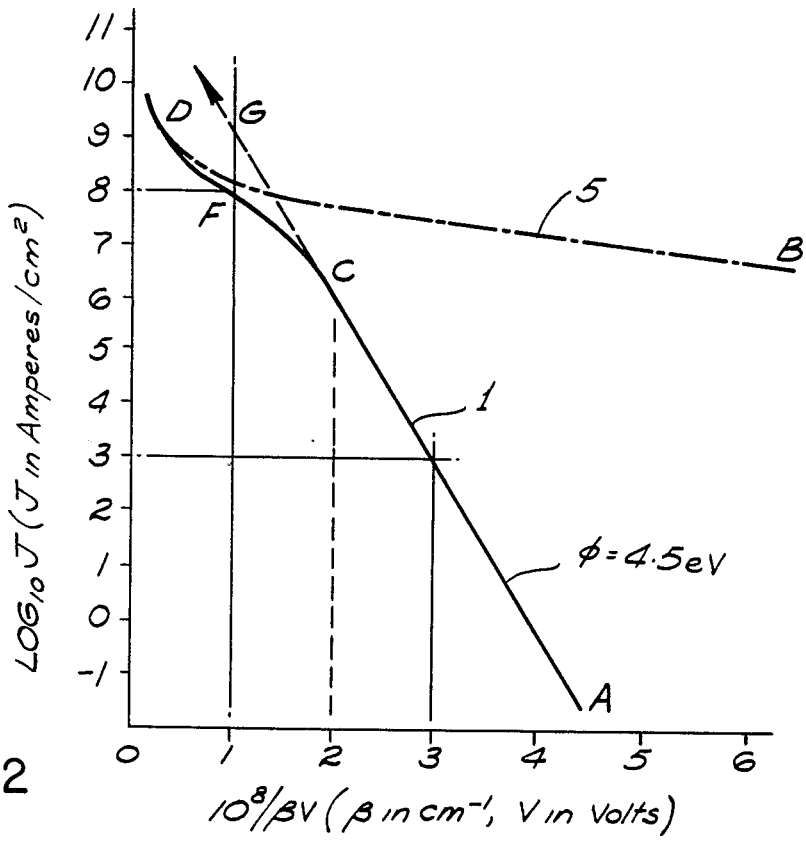
FIG. 2 is a graph showing only the $\phi=4.5$ eV and the space-charge-limited emission curves of FIG. 1.

The phenomenon of "field emission" is well known in the electronic art. FIG. 1, which is taken from an article by Dyck & Dolan ("Advances in Electronics and Electron Physics," Vol. 8, 1956, page 111), is a set of curves showing the common logarithm of the emitter current density (log J) vs the inverse of the field intensity value at the anode and cathode in a field-emission device. The sensitive dependence of emitted current upon electric field ($\beta V$) at the cathode is evident. The curves are for emitters having different work functions ($\phi$). The top curve (5) is for the space-charge-limited emission relation known as "Child's Law", $$J=KV^{3/2}/d^2$$

and serves as an upper limit to the field-emitted current which can be drawn from a cathode at a given temperature (in this case, room temperature). The upper limit exists because negatively charged electrons, which accelerate gradually after emission, form a cloud of electrons near the cathode. The repulsion effect of this cloud of electrons near the cathode reduces the plate current, as shown in FIG. 2.

Here, point G ($10^9$ amps/$cm^2$ and $10^8/\beta V=10^8$ cm/volt) is the current density which would be reached if the negative space charge were not present. The space charge reduces the current density from point G to point F, which is slightly below the space-charge-limit (Child's Law) curve, BD.

The electrons emitted from the cathode ionize residual gas and substances outgassed from the electrodes and the resulting positive ions tend to cancel the effect of the negatively charged electron cloud. Thus, the electric field is increased and the emitted current increases from point F toward point G. This increase in current while the externally applied voltage is held constant is known as "Impedance Collapse" and can be avoided by moving the operating point of the device downward on the AC curve (1) below point C, thus operating at lower field intensity values. The values of $1/\beta V$ which result in relatively trouble-free operation can be seen from the figure to be greater than $2\times10^8$ cm/volt.

The "field enhancement factor", $\beta$, is related to the geometry of the electrodes. For example, for two parallel-plane electrodes, $\beta=1$/electrode spacing. For two concentric spheres of radii a and b, the electric field is $Vb/a(b-a)$. If $b>>a$, $\beta\approx1/a$, independent of b, which means relatively independent of the anode geometry if the smaller sphere is the cathode. In this case, a cathode 10 formed as a cylindrical post 14 mounted upon a cathode base member 22, the post 14 having a spherical zone, preferably hemispherical, tip 12, as shown in FIG. 3, will provide a field enhancement factor, $\beta\approx1/R$, where R is the radius of the hemiphere.

Figure 3:
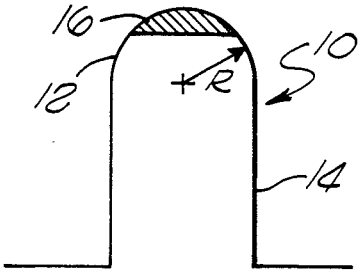
FIG. 3 is a schematic diagram showing a single post and its current-emitting area.
Figure 4:
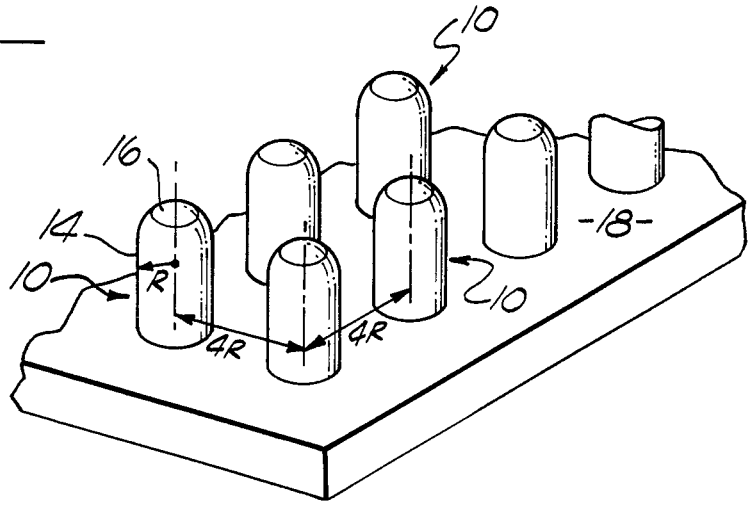
FIG. 4 is a partial isometric drawing of a square array of emitting posts.

The configuration in FIG. 3 is an exemplary embodiment of an emitting post and is not intended to limit the scope of the invention in any way. If the emitting area, or portion, 16 of the hemispherical surface 12 is the upper third, its area is $2\pi R^2/3$. For a given value, V, of applied voltage, and a value of $\beta$ selected from a desired $\beta V$ value for an operating point below point C of curve 1 in FIG. 2, a resulting radius can be calculated from $R\approx1/\beta$. Each specific point along line AC provides a current density from the rounded ends 16 of the protuberances, or posts, 14 which can be read from the Y-axis of FIG. 2.

Figure 5:
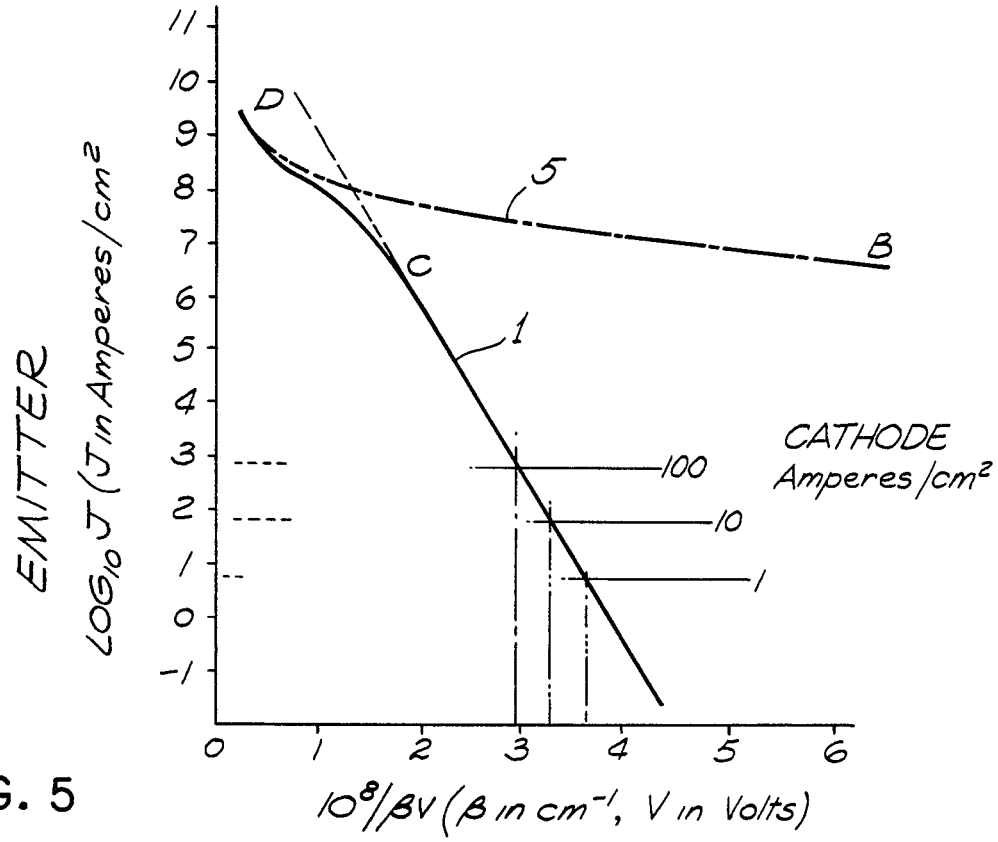
FIG. 5 is a repetition of FIG. 2 with the addition of some usable-current lines which intercept the $\phi=4.5$ eV curve.

If an arrangement of posts is constructed to provide multiple emitting sources, their currents will add. Thus, an array of cylindrical-post emitters spaced a distance of 4R between centers in a square lattice would provide a fraction expressing emitting area to total cathode area $=2\pi R^2/3(16R^2)=0.131=1/7.6$. Usable currents will be provided by this arrangement, as shown by FIG. 5. Three examples of 100, 10, and 1 ampere/cm$^2$ of current density from the total cathode area are indicated and transform to 760, 76 and 7.6 amps/cm$^2$ for each emitting area, i.e., $$\frac{\text{emitting area}}{\text{total cathode area}}=\frac{1}{7.6}=\frac{100}{y}=\frac{\text{total cathode current}}{\text{emitting area current}}$$

The values of $10^8/\beta V$ required for these current densities are 2.93, 3.28 and 3.71 cm/volt. Selecting an applied voltage of 375 KV, the radii at the rounded tips 12 of the posts, or protuberances 14, are $1.10\times10^{-2}$ cm, $1.23\times10^{-2}$ cm and $1.39\times10^{-2}$ cm, respectively.

Figure 6:
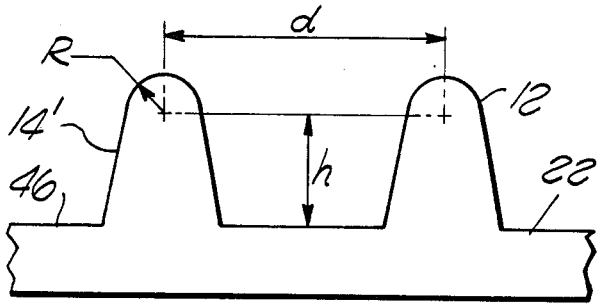
FIG. 6 is a schematic illustration of a conically shaped post.

A second embodiment of the invention is illustrated in FIG. 6. This embodiment employs a conical post 14' with a hemispherical tip 12. The distance between centers of the posts 14' is (d) and the distance from the base to the center of curvature of the hemisphere 12 is (h). A conical shape for the posts 14' improves heat conduction to the cathode base member 22. A typical cone may, for example, be formed with 10° angle between its generatrix and its axis. Assume that the posts are arranged in a hexagonal array on the base 22, as shown in FIG. 8.

Some conditions that will be imposed on the choice of values of R, d and h and the range of values for a "disenhancement factor" that will be acceptable can be determined even though the exact disenhancement factor for a specific geometric configuration is not known. (An emitting post may interfere with the emission of current from neighboring emitting posts and the degree of interference or disenhancement factor, may be expressed in terms of a decimal fraction for multiplying the current generated by a single post. No interference would thus have a disenhancement factor of 1.0.) Acceptable ranges for the disenhancement factor would be from 1.0 to about 0.6, for the ratio d/R from about 8 to about 32, for h from about 2R to 5R. The values of h are determined by the equipotential lines (not shown) which would exist relative to the posts 20 shown in FIG. 6, for example. If the equipotential lines are too flat, the field intensity will be too low for effective current emission. (Flatness of equipotential lines results from lack of height of the posts and/or lack of interpost spacing.) The upper limit for h is determined by fabrication considerations—if h is too great, the posts are too difficult to fabricate. The upper limit on d is governed by the amount of current density desired from the total cathode area, base and all, 22 in FIG. 8.

Figure 8:
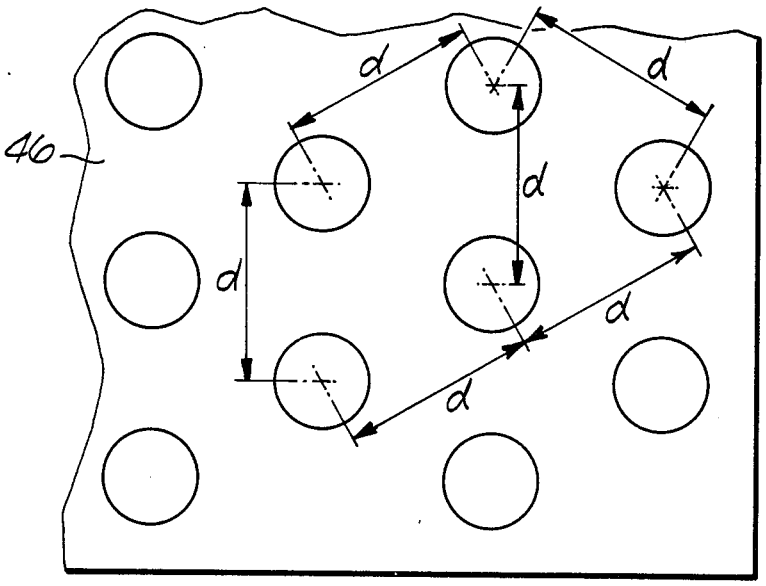
FIG. 8 is a partial schematic showing a hexagonal array of posts.

The steps for designing a hexagonal array, such as that shown in FIG. 8, are the following:

Select initial conditions, e.g.:

desired cathode emission: 10 amps/cm$^2$ anode-to-cathode voltage: 400 KV hexagonal array:

The optimum range for the ratio (d/R) is probably from about 8–32. These values are selected for the following reasons. The larger $\beta$ is, the greater the current emission is. But $\beta=1/R$ and R cannot be too small or else the emission protuberances will melt. Therefore, $\beta$ has an upper limit. However, the amount of current emission increases with the value of $\beta$ and, if $\beta$ is too small, the current is too small.

1. For (d/R) values of 8, 12, 16, 24, 32, construct Table 1.

a. Calculate the emitter fraction, i.e., fraction of cathode surface which is actually emitting. This depends on the geometry of the cathode and for a hexagonal array, with an emitting tip surface area of $2R^2$ (about $\frac{1}{3}$ of the hemispherical area), then $$\text{emitter fraction}=\frac{2R^2}{\sqrt{3/2}\ d^2}=\frac{2R^2}{\sqrt{3/2}\left(\frac{d}{R}\right)^2R^2}=\frac{4}{\sqrt{3(8)^2}}$$

$$=0.0363\ (\text{for } d/R=8)$$

b.

$$\text{Emitter current density}=\frac{\text{given cathode emission}}{\text{emitter fraction}}=\frac{10}{.0363}=275\ \text{Amp/cm}^2$$

TABLE 1

| | | | Values of $10^8/\beta V$ | | | | |
|---|---|---|---|---|---|---|---|
| | | | Disenhancement Factor | | | | |
| d/R | Emitter Fraction | Emitter Current Density | 1.0 | 0.9 | 0.8 | 0.7 | 0.6 |
| 8 | .0363 | 275 AMP/Cm$^2$ | 3.095 | 2.79 | 2.48 | 2.17 | 1.86 |
| 12 | .0161 | 619 | 2.98 | 2.68 | 2.38 | 2.09 | 1.79 |
| 16 | .00908 | 1100 | 2.89 | 2.60 | 2.31 | 2.02 | 1.73 |
| 24 | .00404 | 2475 | 2.77 | 2.49 | 2.22 | 1.94 | 1.66 |
| 32 | .00227 | 4405 | 2.67 | 2.40 | 2.15 | 1.87 | 1.61 |

c. Determine from FIG. 2 the value of $10^8/\beta V$ from the emitter current value found in step 1b (for 275 amp/cm$^2$, $10^8/\beta V=3.095$).

d. The value found for $10^8/\beta V$ in step 1c is for an enhancement factor of 1.0 Calc. $10^8/\beta V$ for enhancement factors of 0.9, 0.8, 0.7 and 0.6 (e.g., $3.095 \times 0.9 = 2.79$)

-continued $$\text{e.g., } \frac{10 \text{ amps/cm}^2}{117 \text{ posts/cm}^2} = 0.085 \text{ amps per post.}$$

TABLE 3

| | No. of Posts per Square Centimeter, Current per Post | | | | | | | | | |
|---|---|---|---|---|---|---|---|---|---|---|
| | Disenhancement Factor | | | | | | | | | |
| d/R | 1.0 | 0.9 | 0.8 | 0.7 | 0.6 | 1.0 | 0.9 | 0.8 | 0.8 | 0.6 |
| | Posts/CM$^2$ | | | | | Post Amps | | | | |
| 8 | 117.8 | 146 | 183 | 240 | 326 | .085 | .068 | .0545 | .042 | 0.31 |
| 12 | 56.4 | 70 | 88 | 115 | 157 | .177 | .144 | .114 | .087 | .064 |
| 16 | 33.7 | 42 | 53 | 70 | 94 | .296 | .240 | .190<br>.145 | .107 | |
| 24 | 16.3 | 20 | 25.5 | 33 | 45 | .613 | .5 | .392 | .303 | .221 |
| 32 | 9.9 | 12 | 12 | 20 | 27.5 | 1.01 | .8.7 | .647 | .5 | .364 |

Figure 7:
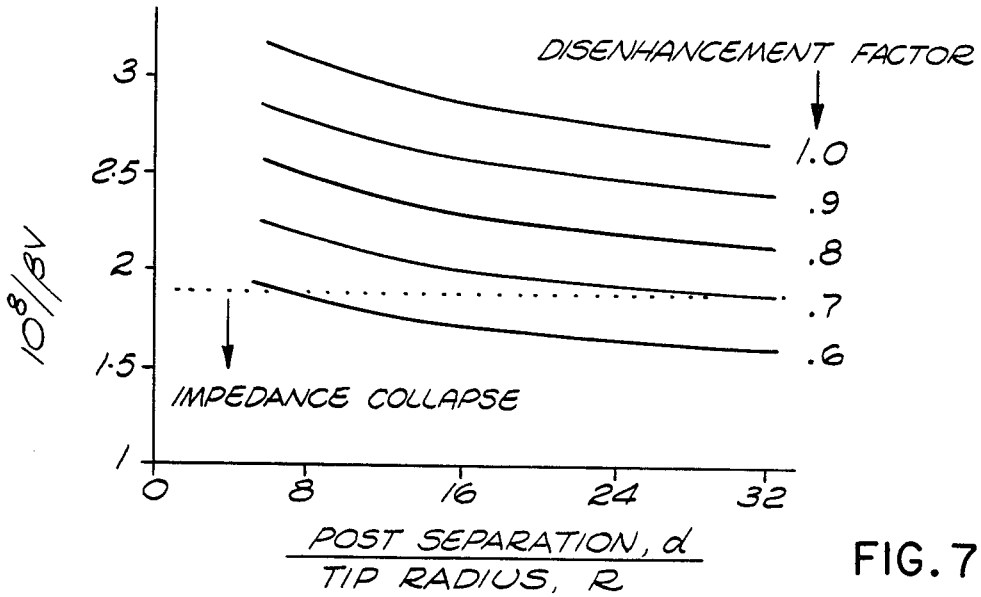
FIG. 7 is a graph of $10^8/\beta V$ vs the ratio of post separation, d, to emitting tip radius, R, for different disenhancement factors.

FIG. 7 is a graph showing the values of $10^8/\beta V$ for the selected values of the d/R ratio and for the selected values of disenhancement factor. It also indicates the location of the impedance collapse value. Note that, because of impedance collapse, it is not prudent to use a disenhancement factor of less than about 0.7.

2. Calculate values from Table 1 values for $10^8/\beta V$ knowing the given value of V is 400 KV. Convert $\beta$ values to R values from the equation $\beta = 1/R$. Thus $\beta = 1/0.01238 = 80.77$.

TABLE 2

| | Actual Post Tip Radius R Required | | | | |
|---|---|---|---|---|---|
| | Disenhancement Factor | | | | |
| d/R | 1.0 | 0.9 | 0.8 | 0.7 | 0.6 |
| 8 | .01238 cm | .0111 cm | .00997 cm | .00867 cm | .007444 cm |
| 12 | .01192 | .01073 | .00954 | .00834 | .00715 |
| 16 | .01156 | .0104 | .00925 | .00809 | .00694 |
| 24 | .01108 | .0100 | .00886 | .0078 | .00665 |
| 32 | .0107 | .0096 | .00854 | .0075 | .00641 |

Figure 9:
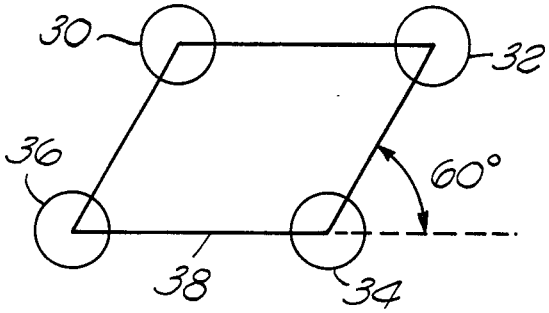
FIG. 9 is a schematic illustration of four posts in a hexagonal array which is used as a basis for calculating the number of posts per $cm^2$ in such an array.

3. Calculate the number of posts per cm$^2$: This can be done for the hexagonal configuration by using a geometrical figure (FIG. 9) corresponding to the tips 16 of four adjacent posts 20. The centers of the tips 16 are connected by a parallelogram 38 which cuts off $\frac{1}{3}$ of the area of each of two tips and $\frac{2}{3}$ of the area of each of the other two tips. Thus, the area of the tips within the parallelogram is equal to the emitting area of one post. The area of the parallelogram 38 is $d(d \sin 60°) = \sqrt{3/2}\, d^2$. Thus, there is 1 post per $\sqrt{3/2}\, d^2 \text{cm}^2$, or $$\frac{1}{\sqrt{\frac{3}{2}}\, d^2}.$$

Therefore, the number of posts/

$$\text{cm}^2 = \frac{1}{\sqrt{\frac{3}{2}}\left(\frac{d}{R}\right)^2 R^2}.$$

Substituting $d/R = 8$ and $R = 0.01238$, this expression equals 117.8.

4. Calc. current per post from ratio $$\frac{\text{cathode current per cm}^2}{\text{no. of posts per cm}^2}$$

5. Calc. (d) for whatever (d/R) ratio is selected. Thus, for $d/R = 8$ and $R = 0.01238$ cm (from step 2), $d = 8R = 0.098$ cm.

The design tables are now complete and can be used for other hexagonal cathode designs. For other geometries, of course, the emitter fraction will change as well as the posts per cm$^2$ and the spacing (d), so other tables are required.

Fabrication of the posts 14 or 14' can be accomplished by forming tiny spheres according to a well-known method. Thus, molten metal of the desired type, e.g., molybdenum, nickel, platinum, etc., is allowed to run through a heated vertical nozzle of a suitable refractory material. The nozzle has an orifice at its lower end and is vibrated in its axial (vertical) direction so that gravity pulls the molten liquid out of the orifice. For a certain range of vibration frequency, one drop per cycle of vibration is released. (This process has been employed to produce a cloud of fuel droplets, a stream of fine metallic shot, and plastic beads of small diameter.) Uniformly sized drops can be selected by allowing the spheres to fall through a viscous liquid where they separate according to radius and weight (equal to viscous drag according to Stoke's Law):

$$6\pi R v m = 4/3 \pi R^3 p,$$

where m is the coefficient of viscosity, v is the velocity of the spheres, p is the density of the spheres, and R is the radius). The largest ones arrive first and the smallest ones last, and both the largest and smallest are discarded. Those arriving during a suitable middle interval are retained and are quite uniform in radius. Surface tension while they are in liquid form causes them to become spherical.

Figure 10:
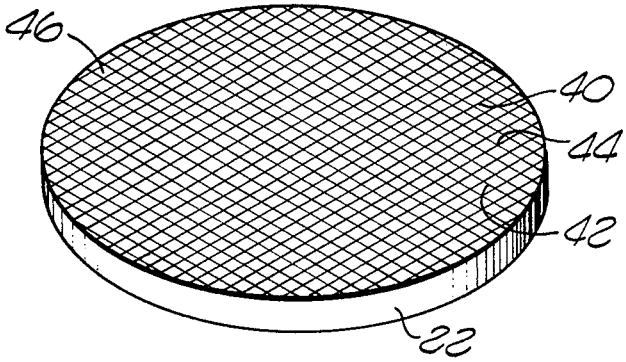
FIG. 10 is an isometric view of a cathode base member upon which protuberances can be formed.
Figure 11:
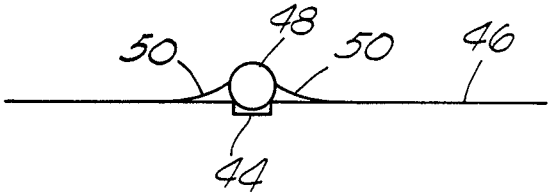
FIG. 11 is a schematic diagram illustrating how a protuberance can be formed on a cathode base member by a sphere lying in an indentation with a build-up of brazing alloy at the base of the sphere.

The surface 46 of a suitably shaped cathode, e.g., a flat piece of copper, is scratched with a cross-hatched pattern as shown in FIG. 10. Where two scratches meet, e.g., 40 and 42, there will be an indentation 44 where a sphere 48 can sit (see FIG. 11) in stable equilibrium when the cathode 46 is horizontal. A brazing alloy 50, such as copper-silver eutectic, can now be placed in carefully measured amount on the copper surface 47. The cathode 46, brazing alloy 50 and spheres 48 are now placed in a hydrogen-atmosphere furnace at a temperature which melts the alloy 50. The melted alloy 50 runs along the scratches, under the spheres, and forms concavely around the bottom of the spheres 48. This gives a ratio h/R which may or may not be suitable. If the ratio is suitable, the cathode is ready for use.

Figure 12:
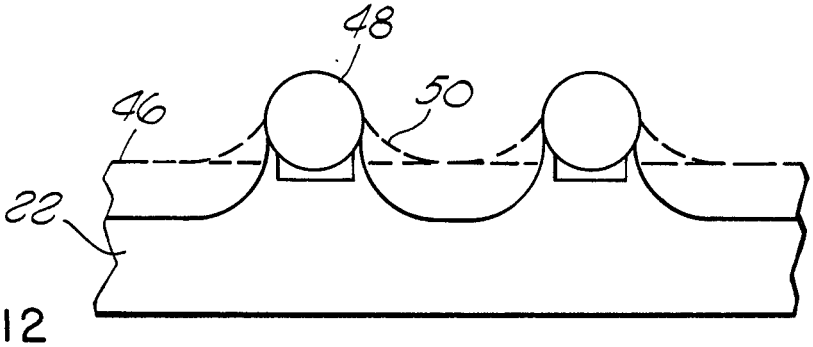
FIG. 12 is a schematic diagram illustrating how the (h) dimension of a post can be increased.

If the ratio is unsuitable, the ratio can be increased as shown in FIG. 12 by etching the alloy 50 and the copper surface 46 with a solution of ferric chloride and dilute nitric acid, for example.

Obviously, many modifications and variations of the present invention are possible in light of the above teachings. It is therefore to be understood that, within the scope of the appended claims, the invention may be practiced otherwise than as specifically described.

What is claimed and desired to be secured by Letters Patent of the United States is:

1. A field-emission device cathode comprising:

a cathode base member; and a plurality of spaced protuberances extending from said base member, the tip of each said protuberance being a spherical zone, each spherical zone having a radius R which is approximately equal to $1/\beta$ where $\beta$ is the field enhancement factor, said R being a value so that the operating point of the tip lies on a point on the curve of the log of emitter current density vs $(10^8/\beta V)$ well below the point at which impedance collapse occurs.

2. A cathode as in claim 1, wherein:

each said spherical zone is hemispherical in contour.

3. A cathode as in claim 1, wherein:

the protuberance is substantially a cylindrical post.

4. A cathode as in claim 1, wherein:

the protuberance is substantially a conical post.

5. A cathode as in claim 1, wherein:

the separation between the axes of any two adjacent protuberances is (d) and the value of the ratio (d/R) lies in the range of about 8 to 32.

6. A cathode as in claim 1, wherein:

the $(10^8/\beta V)$ value is above about $2\times10^8$, $3.6\times10^8$, $4.5\times10^8$ and $5.5\times10^8$ cm/volt for emitting materials having work functions, $\phi$, of 4.5, 3.19, 2.80 and 2.44 eV, respectively.

7. A cathode as in claim 1, wherein:

the $(10^8/\beta V)$ value is above about $2\times10^8$ cm/volt for all emitting materials.

* * * * *